US005458524A

United States Patent [19]

Lucas

[11] Patent Number: 5,458,524

[45] Date of Patent: Oct. 17, 1995

[54] TOYS REPRESENTING LIVING BEINGS, IN PARTICULAR DOLLS

[75] Inventor: Jean-Marie Lucas, Rivarennes, France

[73] Assignee: Corolle S.A., Langeais, France

[21] Appl. No.: 258,922

[22] Filed: Jun. 13, 1994

[30] Foreign Application Priority Data

Jun. 28, 1993 [FR] France ..... 93 07846

[51] Int. Cl.[6] ..... A63H 3/28

[52] U.S. Cl. ..... 446/297; 446/397

[58] Field of Search ..... 446/297, 303, 446/397, 298, 300, 301, 484, 485, 353–356

[56] References Cited

U.S. PATENT DOCUMENTS 3,881,275 5/1975 Baulard-Cogan .
5,073,140 12/1991 Lebensfeld ..... 446/297
5,083,965 1/1992 Mayem ..... 446/297 X

FOREIGN PATENT DOCUMENTS 0032843 1/1981 European Pat. Off. .

*Primary Examiner*—Mickey Yu
*Attorney, Agent, or Firm*—Larson and Taylor

[57] ABSTRACT

The body (2) of the toy (1) includes an effects generator (3) controlled by an electrical control circuit (4) having a pulse counter for counting pulses received from a mechanical generator (5) for generating electrical pulses. The mechanical generator includes a conductive moving body (7) that is displaced inside an enclosure (8) provided with two switch terminals (10, 11) that are insulated from each other, and that are organized such that the motion of the toy (1) can transiently put the body (7) into contact simultaneously with both terminals (10, 11) so as to generate a pulse. After counting a number n of pulses, the circuit (4) switches on the effects generator (3), and it switches off the generator after counting a number m of pulses. Application is to equipping toys representing living beings, such as dolls or fluffy animals.

11 Claims, 1 Drawing Sheet

TOYS REPRESENTING LIVING BEINGS, IN PARTICULAR DOLLS

The invention relates to toys representing living beings, toys such as fluffy animals or animals made of any other material, and among such toys, the invention more especially concerns dolls, because that application seems to be the most advantageous.

For the sake of simplicity, such toys are designated below by the term "doll", naturally by way of non-limiting example.

More particularly, the invention concerns a doll with an effects generator for generating an effect such as a mechanical effect and/or a sound effect and/or a light effect controlled by an electrical control circuit.

Currently, numerous different embodiments of that type of doll are to be found on the market. For example, such dolls move, walk, wave, shed tears, or they emit sounds, and talk or cry, or, more generally, they are animated in the manner of real living beings, and they optionally perform other functions.

In general, the body of such a doll contains a battery-operated electrical animation circuit controlled by an electrical switch.

Whether the electrical switch is accessible from the outside of the doll and is in the form of a button or a lever having two positions (on-off), or whether the switch is disposed inside the doll and is actuated by a magnetic field, e.g. produced by a permanent magnet being brought close to the doll or being inserted in a compartment provided for that purpose in the doll, it is always the child who operates the switch directly so as to start the effects generator, every time.

Often, the child also has to operate the switch directly so as to stop the effects generator.

The action that has to be taken by the child detracts considerably from the magical effect that an animated doll is supposed to produce by appearing to be as alive, spontaneous, and "real" as possible.

An object of the invention is to remedy that drawback and to make a toy of that type as attractive as possible to children, by giving it a "behavior pattern" whereby it produces or ceases to produce a particular effect, e.g. animation or sound emission, in a manner that is as close as possible to reality, in particular in that the doll enables the on-off control of at least one effects generator to be operated almost "spontaneously" while the child is playing with the doll.

To this end, the invention provides a toy representing a living being, such as a doll or a fluffy animal, the toy including at least one effects generator for generating an effect such as a mechanical effect and/or a sound effect and/or a light effect, the effects generator being controlled by an electrical control circuit, said toy being characterized in that it further includes at least one mechanical generator for generating electrical pulses, the mechanical generator comprising at least one electrically-conductive moving body that can move within a confined space delimited in part by at least one electrically-conductive surface forming a first switch terminal, the space having a second electrically-conductive switch terminal which is insulated from the first terminal, so that a moving body coming into contact simultaneously with both terminals generates an electrical pulse, and in that the control circuit includes at least one pulse counter which switches on at least one effects generator when it has counted a first predetermined number n of pulses, and which switches off said effects generator when it has counted a second predetermined number m of pulses.

An advantage of the invention lies in that the effects generator or the function (voice or other mechanism) is not controlled directly by the child. It is started automatically while the child is playing with the toy, and at an indeterminate instant for the child, which instant depends only on the movements and positions that the child gives to the toy, and that have caused the number n of pulses (predetermined at the manufacturing stage of the toy) to be produced in continuous or discontinuous successions. In contrast, the child may then cause the function or the effects generator to stop by moving or displacing the doll such that the second number of pulses m are received by the counter, where m is also predetermined at the manufacturing stage of the toy, and is preferably less than the first number n.

As a result, the doll reacts in a manner that seems to the child to be spontaneous and unexpected, as if the doll were a real living being.

In preferred embodiments, one or more of the following dispositions are used:

at least one conductive body is mounted to move freely inside the volume;

at least one conductive moving body is suspended so as to be free to oscillate inside the volume;

at least one conductive moving body is a rolling body such as a ball;

the second terminal is formed or carried by at least one portion of the surface delimiting the volume;

the second terminal includes at least one electrically-conductive element projecting into the volume;

the volume is delimited by a cylinder provided with at least one electrically-conductive strip formed on its side surface so as to form a terminal;

the volume is delimited by a substantially spherical cap, closed by a substantially planar base provided with a terminal;

the other terminal is delimited by an annular strip formed on the surface of the spherical cap, and not adjacent to the base, at least one electrically-insulating obstacle projecting inwardly into the volume so as to prevent the conductive body from rotating continuously inside the volume while remaining in contact simultaneously with both terminals; and the control circuit includes a single pulse counter that is reset each time the effects generator is switched on or off, so that the second predetermined number m of pulses is counted from the time at which the effects generator is switched on.

The invention will be better understood on reading the following description of a particular embodiment given by way of non-limiting example and with reference to the accompanying drawings, in which.

Figure 1:
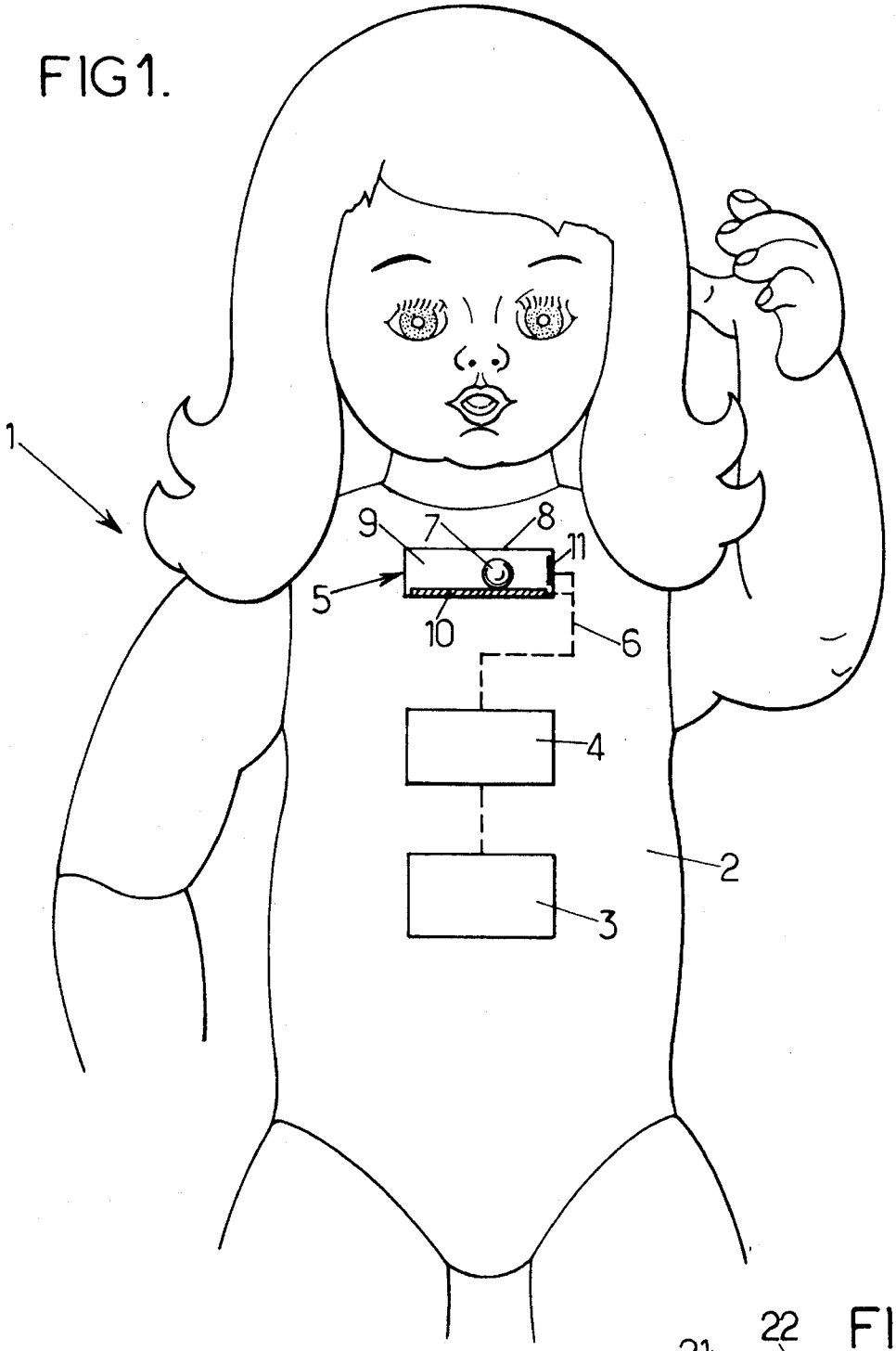
FIG. 1 is a diagrammatic view showing a doll of the invention.

The doll 1 has a body 2 which encloses an animation mechanism or effects generator 3, e.g. a sound effects generator capable of emitting sounds such as short phrases alternated with periods of silence, or crying. For example, the generator 3 comprises a synthetic voice generator, of known design, powered, also in known manner, via a battery-operated electrical circuit (not shown).

But the doll 1 may be animated by the generator or animation mechanism 3 in a quite different way. In a manner known per se, and by way of non-limiting example, the mechanism or generator 3 may in particular enable the doll to move, walk, cry water tears, blush, etc.

The generator or animation mechanism 3 is switched on or off by an electrical or electronic control circuit 4 including an electrical pulse detector equipped with a pulse sensor associated with a reset circuit, alternately after the counter has counted a first number n and a second number m of pulses, which numbers are predetermined during manufacture.

The circuit 4 switches on the animation generator 3 as soon as its counter has counted a number of pulses that is equal to n. Then, after the resulting reset, the circuit 4 stops the animation generator 3 as soon as its counter has counted a number of pulses that is equal to m, thereby resetting the counter, and bringing the circuit 4 to its initial state for a new control cycle.

The detector receives the electrical pulses from a mechanical generator 5 for generating electrical pulses, which generator is connected in known manner to the control circuit 4 via a two-wire line 6 connected in particular to the two terminals of an electrical power supply such as a battery (not shown), preferably the same battery as that required for the animation generator 3 to operate.

The mechanical generator 5 for generating electrical pulses includes an electrically-conductive mechanical body 7 that can be displaced freely inside an enclosure 8 delimiting a closed volume 9. The enclosure 8 has a wall 10 over which the body 7 moves and which is electrically conductive at least over that one of its faces which is inside the enclosure 8. The conductive wall 10 constitutes a switch terminal connected via the line 6 to a terminal of one polarity of the electrical power supply. Another switch terminal 11 projecting into the enclosure 8 or forming another electrically-conductive wall thereof is insulated from wall 10 and connected via the line 6 to the terminal of the other polarity of the electrical power supply. The other portions of the enclosure 8 are electrically insulating, e.g. they are made of plastic. The terminals 10 and 11 are organized such that, when the moving body 7 is in one of the positions that it can take up in the volume 9, while the doll is being moved and displaced by the child, the body 7 comes into contact simultaneously with both terminals 10 and 11, thereby generating an electrical pulse which is detected by the counter detector of the circuit 4.

In the embodiment shown in FIG. 1, the electrically-conductive moving body 7 is a conductive metal ball or a ball provided with a conductive metal coating, the enclosure 8 is a cylinder having a circular cross-section, in which the ball 7 rolls, a conductive longitudinal strip forming terminal 10, which strip runs parallel to the generator line of the cylinder and extends almost from one base of the cylinder to the other over its side face, while terminal 11 is formed on or carried by the central inside portion of an end base of the cylinder 8 so as not to be in contact with terminal 10.

When the child plays with the doll 1 and moves it, the ball 7 is displaced inside the cylinder 8, and it generates a pulse each time it makes contact simultaneously with both terminals 10 and 11. After an indeterminate length of time which is a function only of the movements made by the doll during the game and of the predetermined number n, the detector of the circuit 4 switches on the generator 3 after its counter has counted n pulses. To stop the generator 3, the child must move the doll, e.g. rock it, thereby causing the ball 7 to be displaced, thereby producing new pulses. When the detector of the circuit 4 has counted m pulses, the generator 3 is switched off.

The advantage of this apparatus is that the time taken to count the n pulses is completely indeterminate. It depends only on the game that the child is playing with the doll, and on the movements and positions successively given to the doll.

Moreover, when the doll is stationary, no pulses are delivered. The numbers of pulses n and m are determined when the toy is being designed, and they depend on the desired effect. In general, the numbers n and m are constant, with n being greater than m, but, in an improved version, it is possible for the electronic circuit 4 to include electronic means enabling the numbers n and m to be varied in a relatively random manner within a range of predetermined values.

Figure 2:
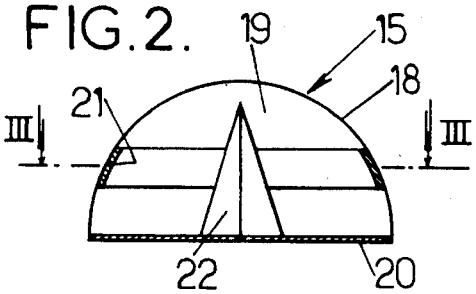
FIG. 2 is a vertical cross-section view on II—II of FIG. 3 showing a variant embodiment of the mechanical generator for generating electrical pulses.
Figure 3:
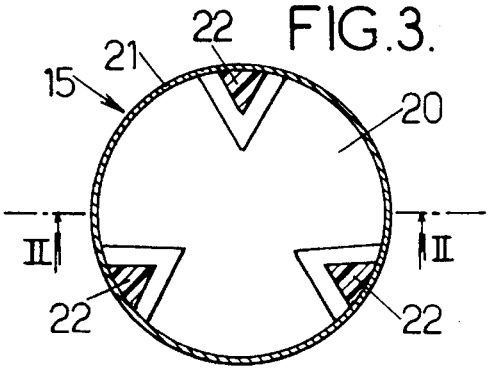
FIG. 3 is a diagrammatic view showing the same variant of the generator in section on III—III of FIG. 2.

In a variant of the mechanical generator 15 for generating electrical pulses, which variant is shown in FIGS. 2 and 3, the conductive moving body (not shown) is also a ball such as 7 in FIG. 1, but the enclosure 18 is a spherical cap or a hemisphere made of an insulating plastic closed by a planar base or an equatorial plane which is electrically conductive, e.g. made of sheet metal, or in which at least the inside face is electrically conductive, e.g. by means of a metal coating on a plastic disk, which base or plane forms a terminal 20 on which the ball can roll.

The other terminal 21 is constituted by an electrically-conductive annular strip delimited on the spherical cap between two planes that are parallel to the equatorial plane. For example, the strip is formed by a strip of sheet metal glued against the inside face of the enclosure 18 or by a localized metal coating on said inside face.

To prevent the conductive ball from rolling over the base 20 while remaining continuously in contact with the annular strip 21, three insulating objects 22, each of which is substantially in the shape of a pyramid of triangular cross-section, are fixed against the base 20 and against the inside face of the spherical cap 18, so as to project into the inside volume 19 thereof, the obstacles being regularly spaced apart circumferentially. The obstacles 22 constrain the ball to move towards the center of the volume 19, in order to multiply the number of occasions on which contact is broken and also on which contact is made simultaneously with both conductive tracks 20 and 21.

To the same end, the base of the enclosure 18 may be not entirely conductive. For example, to constitute terminal 20, said base may have an array of conductive angular sectors, or a cross-shaped conductive array.

In a variant, the annular terminal 21 may be replaced with another terminal projecting into the central portion of the volume 19 at the end of a support, e.g. angularly positioned along the polar axis.

In another variant, the conductive moving body may be swingably mounted like a clapper at the end of a suspended conductive arm freely hinged under one of the terminals at the top of a bell-shaped enclosure, the other terminal being a conductive annular strip on the inside side face of the enclosure.

Unlike the embodiment shown in FIG. 1, the variant shown in FIGS. 2 and 3, and the other variants mentioned are responsive to the doll being displaced by being pivoted or oscillated about two perpendicular axes, whereas the mechanical generator 5 shown in FIG. 1 essentially reacts to oscillations about a single axis only.

Naturally, the embodiment of the moving contact switch used in the invention is not limited to the above-described examples.

I claim:

1. A toy representing a living being comprising:

at least one effects generator for generating an effect for the toy;

an electrical circuit for controlling activation of said effects generator, said electrical circuit including a pulse counter having a cycle (a) that switches on said at least one effects generator when said pulse counter has counted a first predetermined number of n pulses, (b) that is then reset and switches off said at least one effects generator when said pulse counter has counted a second predetermined number m of pulses, and (c) that is then reset to repeat such the cycle; and a mechanical pulse generator which is electrically connected to said electrical circuit for generating electrical pulses to be counted by said at least one pulse counter, said mechanical pulse generator including a confined volume, at least one electrically-conductive surface forming a first switch terminal in said volume, at least one electrically-conductive second switch terminal in said volume and insulated from said first switch terminal, and at least one electrically conductive moving body which moves inside said volume such that, when said volume is moved, said moving body moves in and out of simultaneous contact with both said first and second terminal switches causing electrical pulses to be created and to be counted by said at least one pulse counter.

2. A toy according to claim 1, wherein said at least one conductive body is mounted to move freely inside the volume.

3. A toy according to claim 2, wherein said at least one conductive moving body is a rolling body.

4. A toy according to claim 1, wherein the second terminal is carried by at least one portion of a surface delimiting the volume.

5. A toy according to claim 1, wherein the second terminal includes at least one electrically-conductive element projecting into the volume.

6. A toy according to claim 1, wherein the volume is delimited by a cylinder provided with at least one electrically-conductive strip formed on its side surface so as to form one of said switch terminals.

7. A toy according to claim 2, wherein the volume is delimited by a substantially spherical cap, closed by a substantially planar base provided with one of said switch terminals.

8. A toy according to claim 7, wherein the other of said switch terminals is delimited by an annular strip formed on a surface of the spherical cap, and not adjacent to the base; and further including at least one electrically-insulating obstacle projecting inwardly into the volume so as to prevent the conductive body from rotating continuously inside the volume while remaining in contact simultaneously with both terminals of said switch.

9. A toy representing a living being comprising:

at least one effects generator for generating an effect for the toy;

an electrical circuit for controlling activation of said effects generator, said electrical circuit including at least one pulse counter which switches on said at least one effects generator when said at least one pulse counter has counted a first predetermined number of n pulses and which switches off said at least one effects generator when said at least one pulse counter has counted a second predetermined number m of pulses; and a mechanical pulse generator which is electrically connected to said electrical circuit for generating electrical pulses to be counted by said at least one pulse counter, said mechanical pulse generator including a substantially spherical cap closed by a substantially planar base and forming a confined volume, at least one electrically-conductive surface forming a first switch terminal located on said base, at least one electrically-conductive annular strip forming a second switch terminal located on a surface of said spherical cap and away from said first switch terminal, at least one electrically conductive moving body which moves freely inside the volume, and at least one electrically-insulating obstacle projecting inwardly into the volume so as to prevent said conductive body from moving continuously inside the volume while remaining in contact simultaneously with said first and second terminals whereby movement of the volume causes electrical pulses to be created and counted by said at least one pulse counter.

10. A toy according to claim 9, wherein said at least one conductive moving body is a rolling body.

11. A toy according to claim 9, wherein the control circuit includes a single pulse counter that is reset each time the effects generator is switched on or off, so that the second predetermined number m of pulses is counted from the time at which the effects generator is switched on.

* * * * *